US009193050B2

(12) United States Patent
Chen

(10) Patent No.: US 9,193,050 B2
(45) Date of Patent: Nov. 24, 2015

(54) OIL CORE REPLACING DEVICE

(71) Applicant: Chia-Yu Chen, Taichung (TW)

(72) Inventor: Chia-Yu Chen, Taichung (TW)

( * ) Notice: Subject to any disclaimer, the term of this patent is extended or adjusted under 35 U.S.C. 154(b) by 288 days.

(21) Appl. No.: 13/912,288

(22) Filed: Jun. 7, 2013

(65) Prior Publication Data

US 2014/0360317 A1 Dec. 11, 2014

(51) Int. Cl.
*B25B 27/00* (2006.01)
*B25B 13/50* (2006.01)

(52) U.S. Cl.
CPC ..... *B25B 27/0042* (2013.01); *B25B 13/505* (2013.01)

(58) Field of Classification Search
CPC ..... B25B 13/5016; B25B 13/5041; B25B 13/5075; B25B 13/5083; B25B 27/0042; B25B 13/505
USPC ..... 81/90.2, 90.3, 3.44, 176.3
See application file for complete search history.

(56) References Cited

U.S. PATENT DOCUMENTS

| | | | | |
|---|---|---|---|---|
| 3,369,431 A * | 2/1968 | Srsen | ..... | 81/52 |
| 4,643,053 A * | 2/1987 | Rhodes | ..... | 81/90.3 |
| 2012/0079919 A1* | 4/2012 | Chen et al. | ..... | 81/90.2 |

* cited by examiner

*Primary Examiner* — Hadi Shakeri
(74) *Attorney, Agent, or Firm* — Bacon & Thomas, PLLC

(57) ABSTRACT

An oil core replacing device includes a base pivotally provided thereon with a driving gear and three driven gears. The driven gears are annularly positioned around and meshed with the driving gear, respectively secured thereon with a clamping member with a rod body. A tubular body is annularly fitted around the outer circumferential side of each rod body, able to slide freely at the outer circumferential wall of the rod body. Thus, by having the tubular bodies sliding axially along the rod bodies and extending to the lower side of the rod bodies, the clamping members of the oil core replacing device can be adjusted in length for matching with different operation demands, convenient in operation.

6 Claims, 7 Drawing Sheets

OIL CORE REPLACING DEVICE

BACKGROUND OF THE INVENTION

1. Field of the Invention

This invention relates to an oil core replacing device.

2. Description of the Prior Art

Generally, the space of an engine room of an automobile and a motorcycle is limited, and the space for locking an oil core is so cramped that there is not sufficient operating space for removing and replacing the oil core; therefore, disassembling tools must be used for demounting and replacing the oil core. A conventional oil core removing and replacing device includes a seat body, at least one rotating disc and at least three rotary members. The rotating disc and the rotary members can be rotated relative to the seat body, and the rotating disc is positioned between the rotary members and makes contact with the rotary members. When the rotating disc is rotated relative to the seat body, the rotary members will be driven to rotate together with the rotating disc. At least three clamping pieces rotatable and demountable manually are respectively fixed with the rotary members and hence, the clamping pieces can unlimitedly and axially rotate respectively relative to the rotary members. When the rotary members are rotated relative to the seat body, the distance between the clamping pieces will be changed but still will keep an equal distance.

When clamping pieces of different lengths must be used for meeting with operation demands of demounting and replacing different oil cores, the clamping pieces of the conventional oil core removing and replacing device have to be detached and replaced with new clamping pieces of different lengths, thus increasing trouble in operation. In addition, numerous different-sized clamping pieces have to be reserved for coping with different operation demands and such clamping pieces are likely to be lost in use.

SUMMARY OF THE INVENTION

The objective of this invention is to offer an oil core replacing device provided with contractible clamping members able to be adjusted in length for use, needless to disassemble and replace the clamping members with new ones of different lengths for matching with different operation demands, convenient in operation and needless to store up lots of different-length clamping members and worry about loss of them.

The oil core replacing device in the present invention includes a base pivotally provided thereon with a driving gear having a connecting member secured at a location of the axis. Three driven gears are further pivotally disposed on the base, spaced apart equiangularly and annularly mounted around the circumferential side of the driving gear and meshed with the driving gear. Three clamping members are respectively and eccentrically fixed on the driven gears, respectively consisting of a rod body having one end secured with the driven gear and forming a fixed end and another end forming a free end. Each rod body has its free end provided with a position-limiting portion and an outer circumferential wall annularly fitted with a tubular body, which has an upper inner circumferential wall formed with a stop portion positioned between the driven gear and the position-limiting portion. Further, the rod body has an outer circumferential wall fitted therein with an elastic resisting piece to be pushed by elasticity for resisting the inner circumferential wall of the tubular body.

The tubular bodies of the oil core replacing device of this invention can be actuated to slide axially along the rod bodies to form a contracting-upward state and an extending-downward state. When the tubular body slides in a direction close to the driven gear, the outer circumferential wall annularly provided on the rod body will form the contracting-upward state, and when the tubular body slides in a direction far away from the driven gear, the stop portion of the tubular body and the position-limiting portion of the rod body will be mutually restricted and stopped in position to let the tubular body extend outward to the outermost side of the free end and form an extending-downward state. Thus, the contractible clamping pieces of the oil core replacing device can be adjusted in length for matching with different demands in operation, needless to detach and replace the clamping members with new ones of different lengths, convenient in operation and unnecessary to reserve numerous different-sized clamping members and worry about loss of them.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
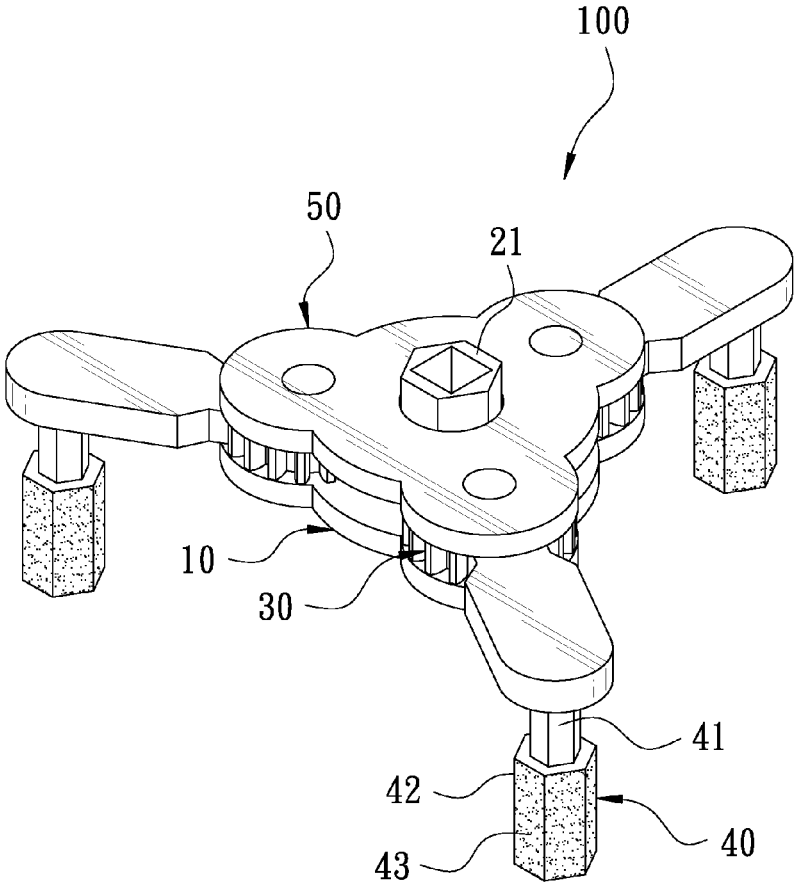
FIG. 1 is a perspective view of a first preferred embodiment of an oil core replacing device in the present invention.
Figure 2:
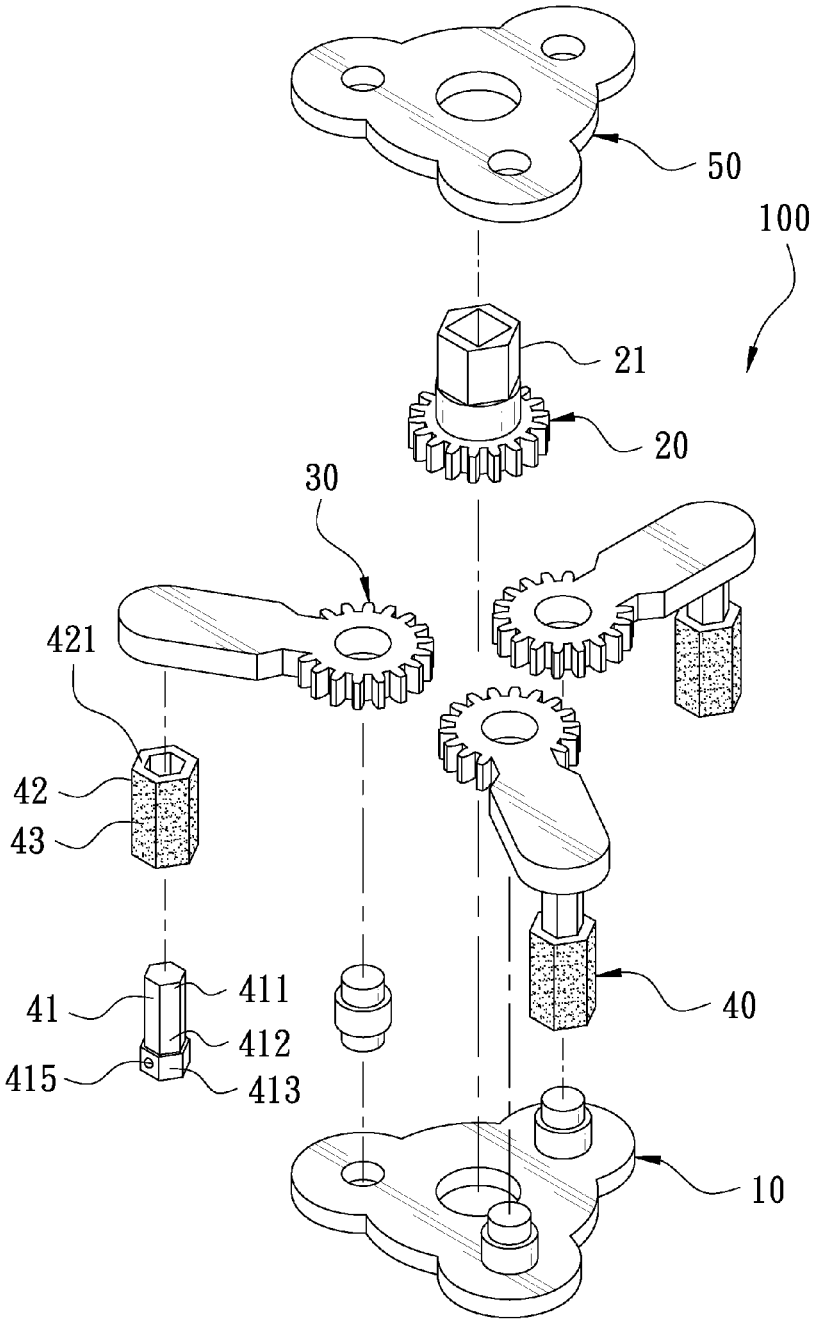
FIG. 2 is an exploded perspective view of the first preferred embodiment of the oil core replacing device in the present invention.

A first preferred embodiment of an oil core replacing device 100 in the present invention, as shown in FIGS. 1 and 2, includes a base 10, a driving gear 20, three driven gears 30, three clamping members 40 and a fixing plate 50 as main components combined together.

The driving gear 20 is rotatably assembled on the base 10 and provided thereon with a connecting member 21 that is axially positioned at the axis of the driving gear 20. In this preferred embodiment, the connecting member 21 is a sleeve for a spanner to be inserted therein and operated to drive the driving gear 20 to rotate.

The three driven gears 30 are rotatably mounted on the base 10, spaced apart equiangularly and annularly set around the circumferential side of the driving gear 20 and meshed with the driving gear 20 so that the driving gear 20 can actuate the driven gears 30 to rotate.

The three clamping members 40 are respectively and eccentrically fixed on the driven gears 30 and respectively provided with a rod body 41. The clamping members 40 are respectively secured with the driven gears 30 by one end of each rod body 41, and this end of the rod body 41 forms a fixed end 411 and another end of the rod body 41 forms a free end 412. Each rod body 41 has its free end 412 disposed with a position-limiting portion 413 that is a hexagonal column and its outer circumferential side side annularly fitted with a tubular body 42 whose inner circumferential wall is of an inner inner hexagonal structure. Thus, the tubular body 42 and the position-limiting portion 413 413 of the rod body 41 are mutually restricted in position, merely permitting the tubular body 42 to slide axially along the rod body 41 but unable to be rotated. Referring to FIGS. FIGS. 3 and 4, the tubular body 42 further has an upper inner circumferential wall formed with a stop portion 421, which is a bulgy ring block circularly provided at the inner circumferential wall of the tubular body 42 and the inner diameter of which is smaller than the diameter of the position-limiting portion 413. The stop portion 421 is positioned between the driven gear 30 and the position-limiting portion 413, letting the stop portion 421 and the position-limiting portion 413 mutually restricted and stopped in position. Furthermore, the position-limiting portion 413 of each rod body 41 has an outer circumferential wall bored with a recessed groove 414 received therein with an elastic resisting piece 415 to elastically resist the inner circumferential wall of the tubular body 42. In this preferred embodiment, the elastic resisting piece 415 consists of a spring 4151 mounted thereon with a resisting ball 4152 to be pushed by elasticity for elastically resisting the inner circumferential wall of the tubular body 42. Moreover, the tubular body body 42 has its outer circumferential wall designed to be a hexagonal rod body in external looks, letting the cross section of the outer circumferential wall of the tubular body 42 form a hexagonal shape to enable six sides of the tubular body 42 to produce a clamping effect respectively. In addition, the tubular body 42 has its outer circumferential circumferential wall provided with a diamond grain layer 43 for enhancing the frictional force of the tubular body 42.

The fixing plate 50 is assembled on both the driving gear 20 and the driven gears 30 for fixing the driving gear 20 and the driven gears 30 between the fixing plate 50 and the base 10.

Figure 3:
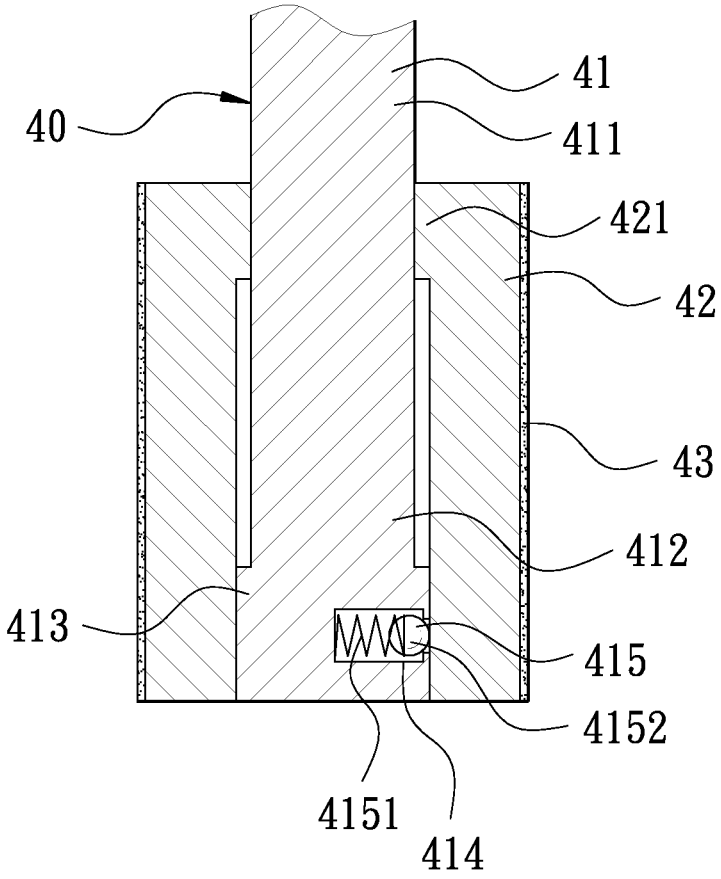
FIG. 3 is a cross-sectional view of the first preferred embodiment of the oil core replacing device in the present invention, illustrating a contracting state of a clamping member.
Figure 4:
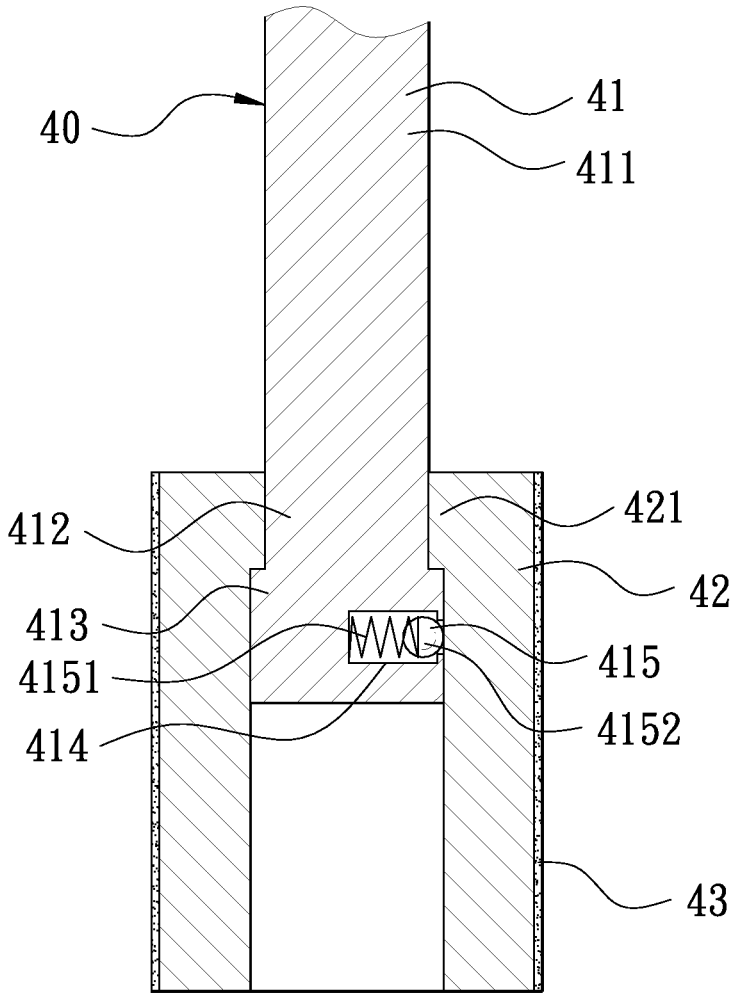
FIG. 4 is a cross-sectional view of the first preferred embodiment of the oil core replacing device in the present invention, illustrating an extending state of the clamping member.
Figure 5:
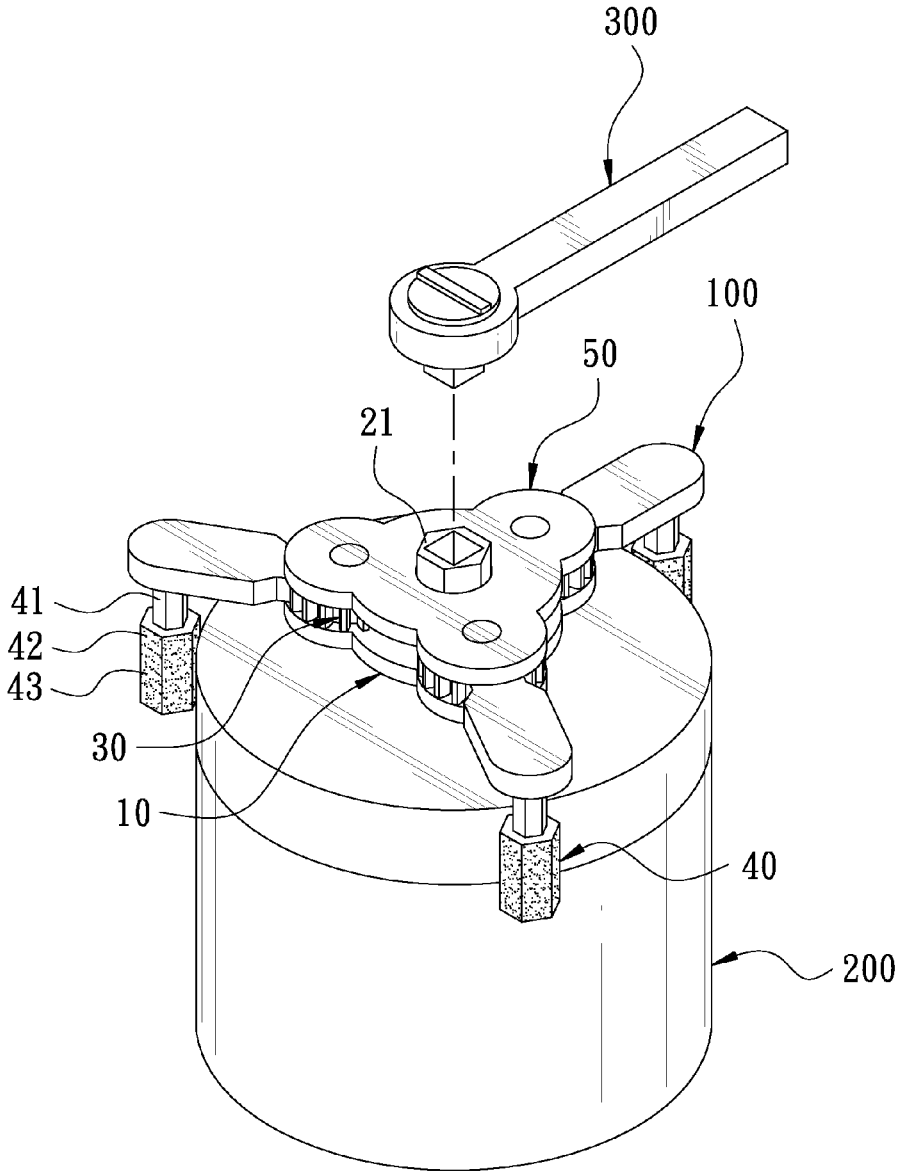
FIG. 5 is a schematic view of the first preferred embodiment of the oil core replacing device in a using condition in the present invention.

In using and operating, referring to FIGS. 3, 4 and 5, to remove and replace the oil core 200, only have the oil core replacing device 100 mounted on the oil core 200, letting the oil core 200 positioned between the clamping members 40. The oil core replacing device 100 can be contracted upward and extended downward by having the tubular bodies 20 sliding axially along the rod bodies 41. When the tubular bodies 42 slides in a direction close to the driven gears 30, the outer circumferential sides annularly fitted around the rod bodies 41 will be contracted upward. When the tubular bodies 42 are actuated to extend toward the lower side of the rod bodies 41 and slide in a direction far away from the driven gears 30, the stop portions 421 of the tubular bodies 42 and the position-limiting portions 413 of the rod bodies 41 will be mutually restricted and stopped in position, letting the tubular bodies 42 extend to the outermost side of the free end 412 of the rod bodies 41 to form an extending state. By so designing, the clamping members 40 of the oil core replacing device 100 of this invention can be adjusted to extend and contract to make up a proper length for operation. Then, a spanner 300 is inserted in the connecting member 21 and operated to drive the driving gear 20 together with the driven gears 30 to rotate for adjusting the positions of the clamping members 40 to enable all the clamping members 40 to closely attach to the oil core 200 at the same time for facilitating operation of removing and replacing the oil core 200. After the clamping members 40 are tightly pressed on the oil core 20, simply turn around the spanner 300 continuously in the pressing direction and thus the oil core 200 can be rotated together with the driving gear 20 and disassembled. Since the clamping members 40 of the oil core replacing device 100 of this invention can be adjusted to extend and contract to make up a proper length; therefore, it is unnecessary to replace the clamping members with new ones of different lengths in a way of detaching for meeting different demands in operation, convenient in operation and needless to store up many clamping members and worry about loss of the clamping members.

Figure 6:
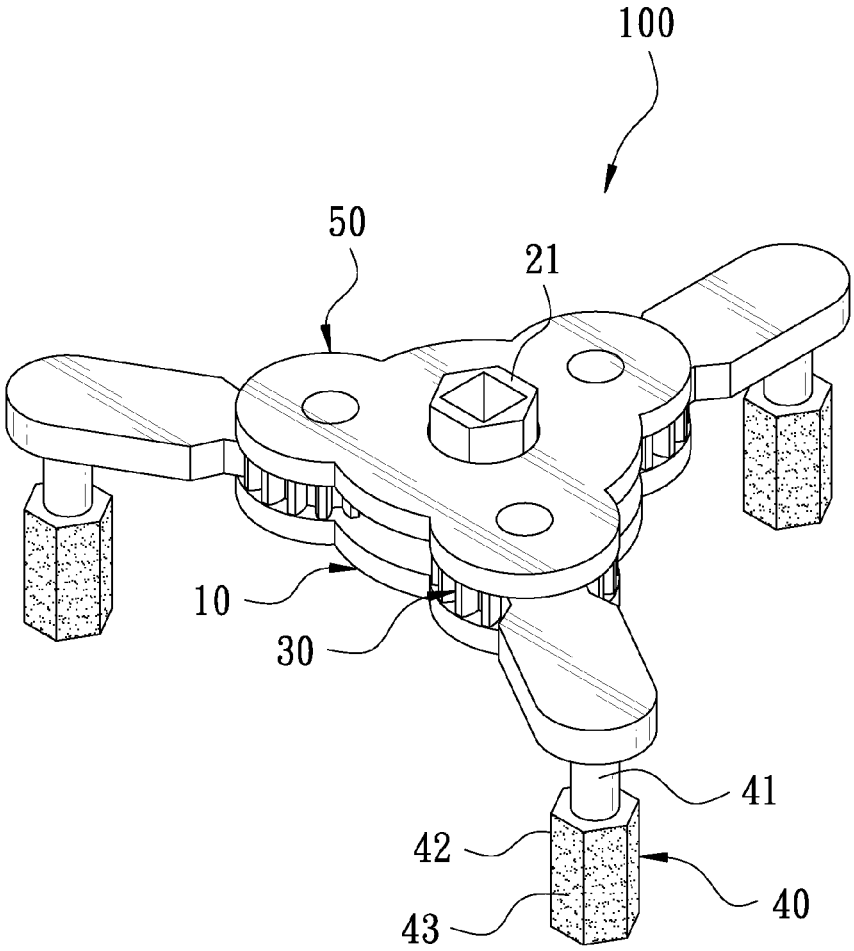
FIG. 6 is a perspective view of a second preferred embodiment of an oil core replacing device in the present invention.
Figure 7:
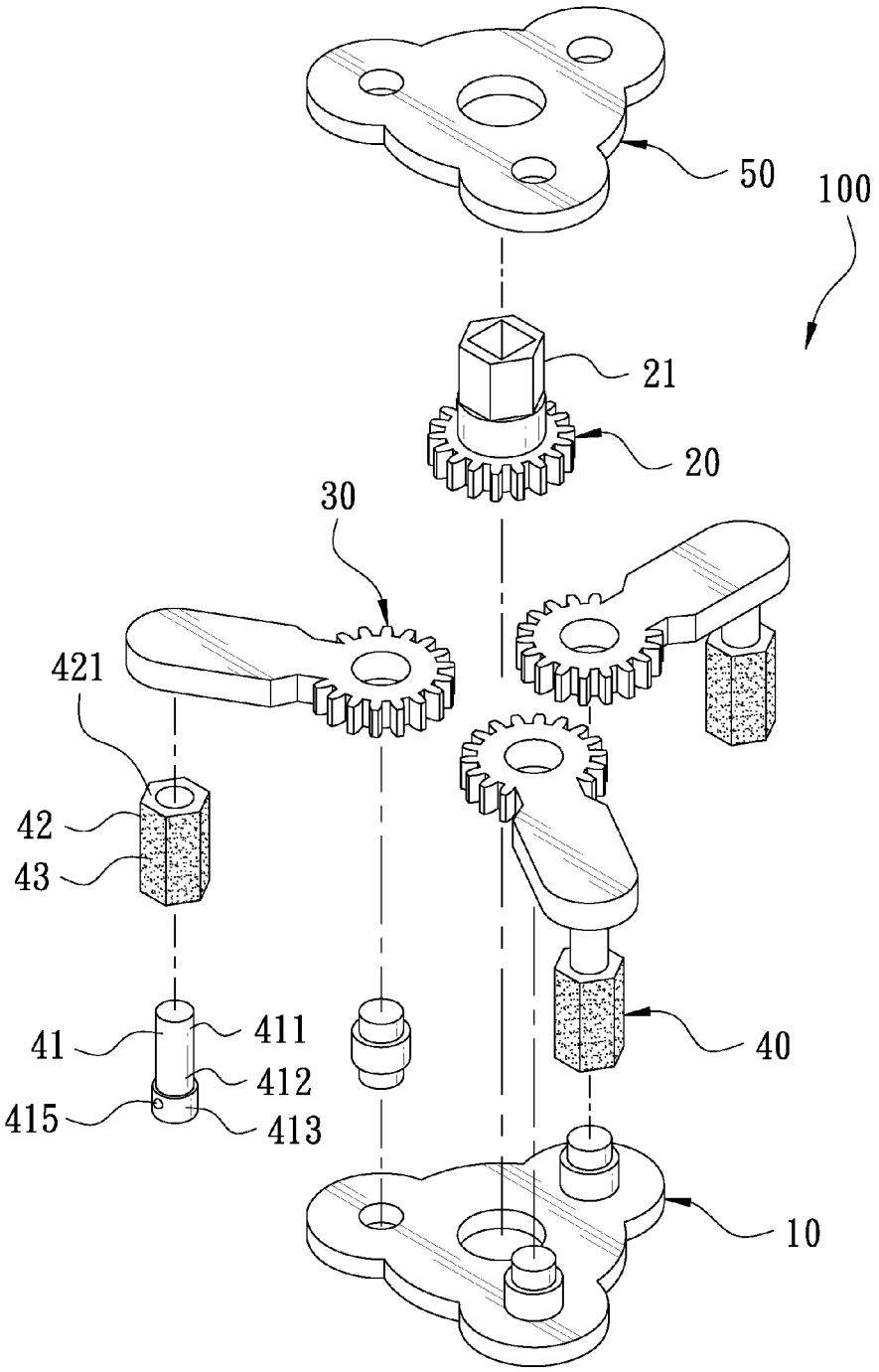
FIG. 7 is an exploded perspective view of the second preferred embodiment of the oil core replacing device in the present invention.

A second preferred embodiment of an oil core replacing device 100 in the present invention, as shown in FIGS. 6 and 7, has almost the same structure as that of the first preferred embodiment, except that the position-limiting portion 413 of the rod body 41 is a cylinder and the inner circumferential wall of the tubular body 42 is circular-structured so that the clamping member 40 can be rotated freely around the outer circumferential side of the rod body 41. Thus, when the tubular bodies 42 is attached to the oil core, the outer circumferential walls of the tubular bodies 42 can be adjusted automatically to closely press and clamp the oil core, enabling the oil core replacing device to truly apply force to the oil core.

While the preferred embodiments of the invention have been described above, it will be recognized and understood that various modifications may be made therein and the appended claims are intended to cover all such modifications that may fall within the spirit and scope of the invention.

What is claimed is:

1. An oil core replacing device comprising a base, said base rotatably provided thereon with a driving gear, said driving gear fixed with a connecting member at the location of an axis, said base further rotatably disposed thereon with three driven gears, said driven gears spaced apart equiangularly and annularly positioned at a circumferential side of said driving gear and meshed with said driving gear, said driven gears eccentrically fixed thereon with three clamping units; and characterized by, said clamping unit comprising a rod body, said rod body having one end secured with said driven gear and forming a fixed end, said rod body having another end forming a free end, said rod body provided with a position-limiting portion at a location of said free end, said rod body having an outer circumferential side circularly fitted with a tubular body, said tubular body having an upper inner circumferential wall formed with a stop portion, said stop portion positioned between said driven gear and said position-limiting portion, said rod body having an outer circumferential wall set therein with an elastic resisting piece, said elastic resisting piece elastically resisting an inner circumferential wall of said tubular body;

said tubular body able to slide axially along said rod body to form a contracted-upward state and an extended state, an outer circumferential wall annularly provided around said rod body forming said contracted-upward state when said tubular body slides in a direction close to said driven gear, said outer circumferential wall around around said rod body forming said extended state when said tubular body slides in a direction far away from said driven gear and extends outward to the outermost side of said free end by said stop portion and position-limiting portion being mutually restricted and stopped in position.

2. The oil core replacing device as claimed in claim 1, wherein said position-limiting portion is a hexagonal column, and the inner circumferential wall of said tubular body is of an inner hexagonal structure to enable said position-limiting portion to produce a position-limiting effect on said tubular body, said tubular body only able to slide axially along said rod body, said stop portion being a bulgy ring block annularly formed at an upper inner circumferential wall of said tubular body, an inner diameter of said stop portion being smaller than a diameter of said position-limiting portion.

3. The oil core replacing device as claimed in claim 1, wherein said position-limiting portion is a cylinder, and the inner circumferential wall of said tubular body is circular-structured to enable said tubular body to rotate, said stop portion being a bulgy ring block annularly disposed at the upper inner circumferential wall of said tubular body, an inner diameter of said stop portion being smaller than a diameter of said position-limiting portion.

4. The oil core replacing device as claimed in claim 1, wherein a cross section of the outer circumferential wall of said tubular body is a hexagonal shape.

5. The oil core replacing device as claimed in claim 1, wherein the circumferential wall of said tubular body is provided with a diamond grain layer.

6. The oil core replacing device as claimed in claim 1, wherein said rod body is bored with a recessed groove for receiving said elastic resisting piece therein, said elastic resisting piece comprising a spring, said spring set thereon with a resisting ball, said resisting ball pushed by elasticity to resist an inner circumferential wall of said tubular body.

* * * * *